US006726035B2

(12) United States Patent
Zadak

(10) Patent No.: US 6,726,035 B2
(45) Date of Patent: Apr. 27, 2004

(54) SHELF ASSEMBLY HAVING ADJUSTABLE SUPPORT CARRIER BRACKET

(75) Inventor: Craig Zadak, Roscoe, IL (US)

(73) Assignee: Southern Imperial, Inc., Rockford, IL (US)

( * ) Notice: Subject to any disclaimer, the term of this patent is extended or adjusted under 35 U.S.C. 154(b) by 0 days.

(21) Appl. No.: 10/198,246

(22) Filed: Jul. 18, 2002

(65) Prior Publication Data

US 2004/0011752 A1 Jan. 22, 2004

(51) Int. Cl.[7] ..... A47F 5/08

(52) U.S. Cl. ..... 211/90.03; 211/90.02; 211/106; 211/133.5

(58) Field of Search ..... 211/90.03, 90.02, 211/103, 106, 181.1, 126.9, 133.5

(56) References Cited

U.S. PATENT DOCUMENTS 3,229,823 A * 1/1966 Hummer ..... 211/181.1
3,294,351 A * 12/1966 Rollins, Jr. ..... 211/90.03
3,495,718 A * 2/1970 Romero ..... 211/88.01
3,627,247 A * 12/1971 Krikorian ..... 211/126.9
4,109,797 A * 8/1978 Brunette ..... 211/133.5
4,349,113 A * 9/1982 Schreiner ..... 211/103
5,133,463 A * 7/1992 Merl ..... 211/181.1

* cited by examiner

*Primary Examiner*—Daniel P. Stodola
*Assistant Examiner*—Erica B Harris
(74) *Attorney, Agent, or Firm*—Leydig, Voit & Mayer, Ltd.

(57) ABSTRACT

A retail display assembly generally comprises a display member, a display support, and first and second mounting brackets. The display support is attached to the display member and includes a first horizontal member and first and second vertical members attached to opposing ends of the first horizontal member. The first mounting bracket is attached to a first end of the display support and is structured for attachment to the vertical support. The second mounting bracket is attached to a second end of the display support and is structured for attachment to the vertical support. The second mounting bracket is horizontally adjustable along the display support to vary the distance between the first and second mounting brackets.

14 Claims, 4 Drawing Sheets

SHELF ASSEMBLY HAVING ADJUSTABLE SUPPORT CARRIER BRACKET

FIELD OF THE INVENTION

This invention pertains to mounting structures for retail display assemblies, and more particularly relates to adjustable mounting of shelf assemblies.

BACKGROUND OF THE INVENTION

In the field of retail display, display assemblies are mounted on a vertical support for presenting merchandise to the customer. One such vertical support includes two vertical beams or tubing spaced apart a given distance and connected by a board. The vertical beams include a plurality of vertically spaced slots for attaching various display apparatus, such as shelving assemblies, at any desired height.

Typically, these vertical beams are horizontally spaced at regular intervals, i.e. four feet being a common distance. Generally, these vertical beams cannot always be precisely spaced apart. Unfortunately, most display assemblies, and more particularly their attachment structures, are based on this regular interval or distance. Thus there can be some difficulty in attaching these display assemblies to two vertical supports that are slightly imperfect, that is not perfectly spaced.

Accordingly, there exists a need to provide a display assembly, and more particularly, a support structure, that overcomes these difficulties and allows the assembly to be mounted to such vertical supports.

BRIEF SUMMARY OF THE INVENTION

One embodiment of the invention provides a retail display assembly for displaying merchandise on a vertical support. The display assembly generally comprises a display member, a display support, and first and second mounting brackets. The display member is structured to display merchandise. The display support is attached to the display member and includes a first horizontal member and first and second vertical members attached to opposing ends of the first horizontal member. The first mounting bracket is attached to a first end of the display support and is structured for attachment to the vertical support. The second mounting bracket is attached to a second end of the display support and is structured for attachment to the vertical support. The second mounting bracket is horizontally adjustable along the display support to vary the distance between the first and second mounting brackets.

According to more detailed aspects of this embodiment, the second mounting bracket is attached to the first horizontal member at the second end of the display support. Preferably, the second mounting bracket includes a main portion and a flange portion. The main portion is structured to lie against the vertical support while the flange portion is structured to project outwardly from the main portion. The flange portion is connected to the first horizontal member, and preferably includes an aperture sized to receive the first horizontal member. More specifically, the flange portion may include a first flange plate having the aperture and a second flange plate laterally spaced from and parallel to the first flange plate, the second flange plate having a second aperture aligned with the aperture and sized to receive the first horizontal member. Further, the display support may also include a second horizontal member attached to the first and second vertical members. In that case, the flange portion includes a second aperture sized to receive the second horizontal member, the first and second apertures being vertically spaced apart.

Another embodiment of the invention provides a support structure for a product display apparatus, the support structure being adapted for connection to a vertical support. The support structure generally comprises first and second horizontal rods, first and second posts, and first and second backs. The first horizontal rod and second horizontal rod are vertically spaced apart. The first post is attached to a first end of the first and second rods. The second post is attached to a second end of the first and second rods opposite the first end. The first back is mounted to either the first post or the first and second horizontal rods at the first end. Finally, the second back is slidably mounted to the first and second horizontal rods for adjusting the distance between the first and second backs.

According to more detailed aspects of this embodiment, the second back includes a flange projecting outwardly relative to the vertical support. The flange preferably includes a pair of vertically spaced apertures sized and positioned to slidably receive the first and second horizontal rods. Preferably, the flange is positioned inside of the second post, which limits the horizontal movement of the second back. Typically, the first back is fixedly mounted to either the first post or the first and second horizontal rods at the first end.

Yet another embodiment of the invention provides a support structure for a product display apparatus that is adapted for connection to a vertical support. The support structure generally comprises a first horizontal member, first and second vertical members, and first and second backs. The first and second vertical members are attached to opposing ends of the first horizontal member. The first back is attached to one of the first vertical member and the first horizontal member, and includes a prong for attachment to the vertical support. The second back is connected to the first horizontal member and has a prong for attachment to the vertical support. Finally, the second back includes a main portion and a flange portion. The flange portion extends transversely relative to the main portion and projects outwardly from the vertical support. The flange portion forms a first passageway sized to slidably receive the first horizontal member for adjusting the distance between the first and second backs.

These and other advantages of the invention, as well as additional inventive features, will be apparent from the description of the invention provided herein.

DETAILED DESCRIPTION OF THE INVENTION

The following examples further illustrate the invention but, of course, should not be construed as in any way limiting its scope.

Figure 1:
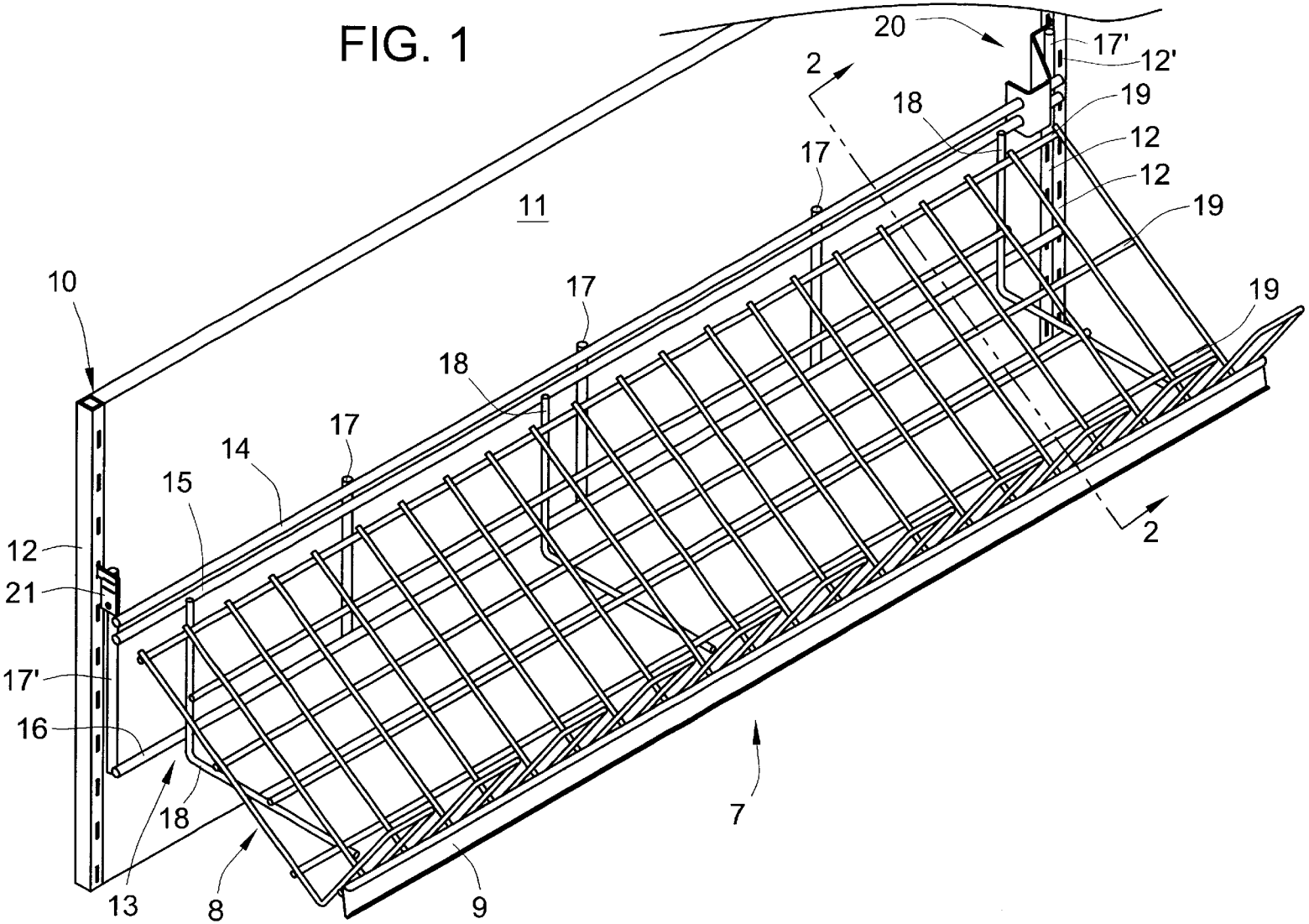
FIG. 1 illustrates a perspective view of a retail display assembly constructed in accordance with the teachings of the present invention.

Turning now to the figures, FIG. 1 depicts a perspective view of a retail display assembly 7, and more particularly, a shelf assembly. The shelf assembly is structured for attachment to a vertical support 10. The vertical support has been depicted as two vertical beams 12 attached to opposing ends of a board 11. The vertical beams 12 are preferably tubing, and include a plurality of vertically-spaced apertures 12' (FIG. 3) which are used to mount retail display apparatus, here shelf assembly 7. The shelf assembly generally includes a shelf member 8 and a support structure 13 connected to the shelf member 8 for providing attachment to the vertical support 10.

Figure 2:
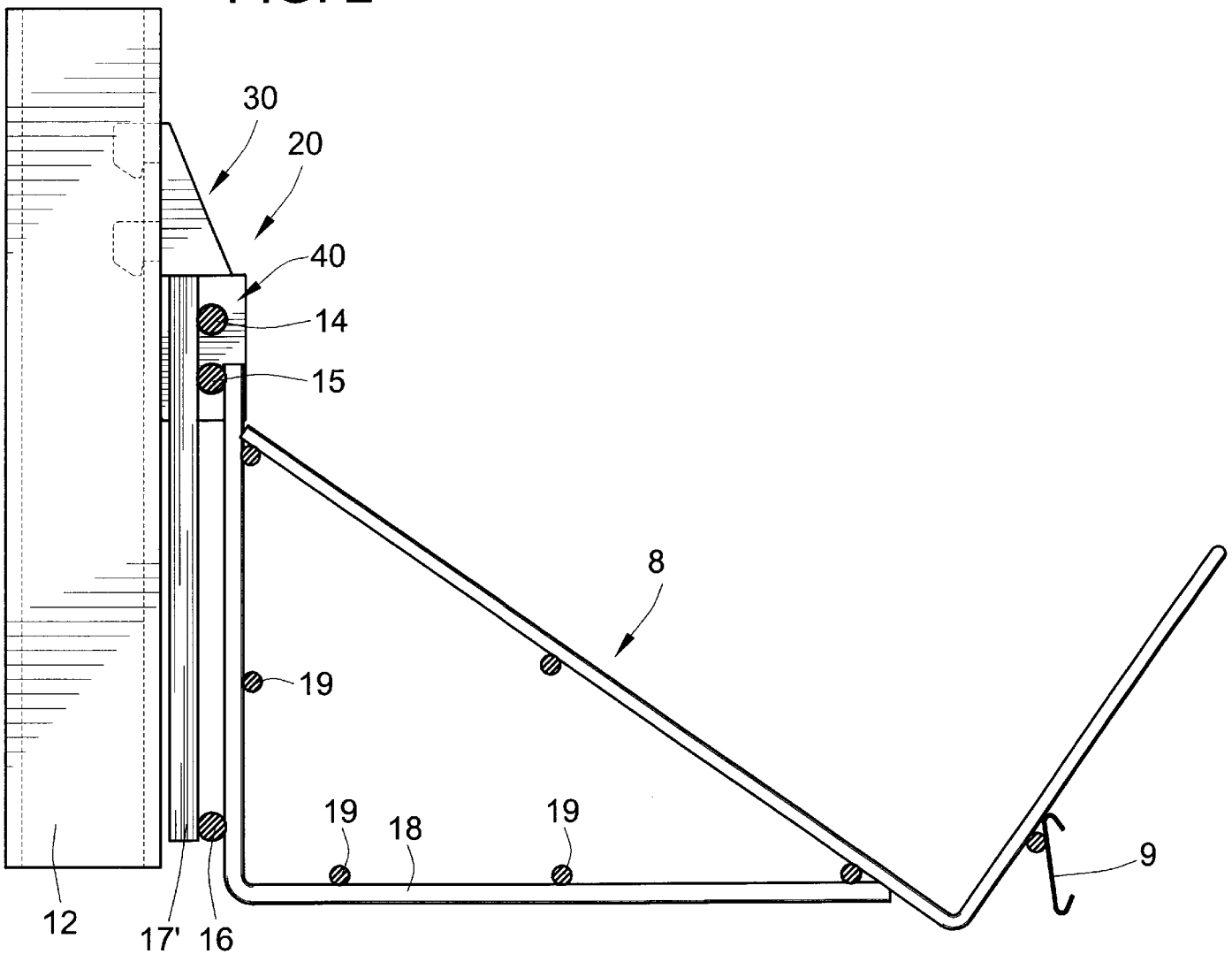
FIG. 2 illustrates an enlarged cross-sectional view, taken left of line 2—2 in FIG. 1.

The shelf member 8 generally comprises a grid formed of metal wire. The grid structure is preferably welded together. As best seen in the cross-sectional view of FIG. 2, the main surface of the shelf member 8 is angled downwardly and outwardly, but then turns upwardly and outwardly to form an L-shaped shelf. The upturned portion of the shelf member 8 includes a display channel 9 for receiving various labels or other indicia. As will be apparent to those skilled in the art, the depicted shelf member 8 is one of may possible shelf members, and further is one of many possible retail displays that may be employed in conjunction with the present invention.

The retail display assembly 7 is attached to the support structure 13 for connection to the vertical support 10. The support structure 13 generally includes several horizontal and vertical members. More particularly, first, second and third horizontal members or rods 14, 15, 16, respectively, are vertically spaced apart from each other. Preferably, the first and second horizontal members 14, 15 are spaced closer together and well above the third horizontal member 16. The three horizontal members, 14, 15, 16 are linked by a plurality of vertical members or posts, which have been identified by reference numeral 17. Two of these posts 17 are attached to opposing ends of the horizontal members 14, 15, 16, and have been denoted as 17'.

Preferably the horizontal rods 14, 15, 16 and posts 17, 17' are welded together. For this particular retail display apparatus 7, the support structure 13 also includes a plurality of L-shaped members 18 having a first portion being vertically oriented and connected to the horizontal members, and more particularly attached to the second and third horizontal members 15, 16 as shown. The L-shaped members 18 are connected to each other by way of connecting rods 19 as shown, preferably by appropriate welds. The L-shaped members 18 support the shelf member in a position to support and display merchandise as described above.

The outer ends of the support structure 13 include mounting brackets or backs, 20, 21 for attaching the support structure 13, and in turn the retail display assembly 7, to the vertical support 10. Mounting bracket 21 is fixedly connected to the support structure 13, and has been shown as attached to one of the outer vertical members 17'. The mounting bracket 21 can take many forms, but has been illustrated as a simple plate having a prong extending rearwardly and downwardly for connection to the vertical beam 12. It will also be recognized that the mounting bracket 21 could be attached to any portion of the support structure 13, such as the horizontal members 14, 15.

Figure 5:
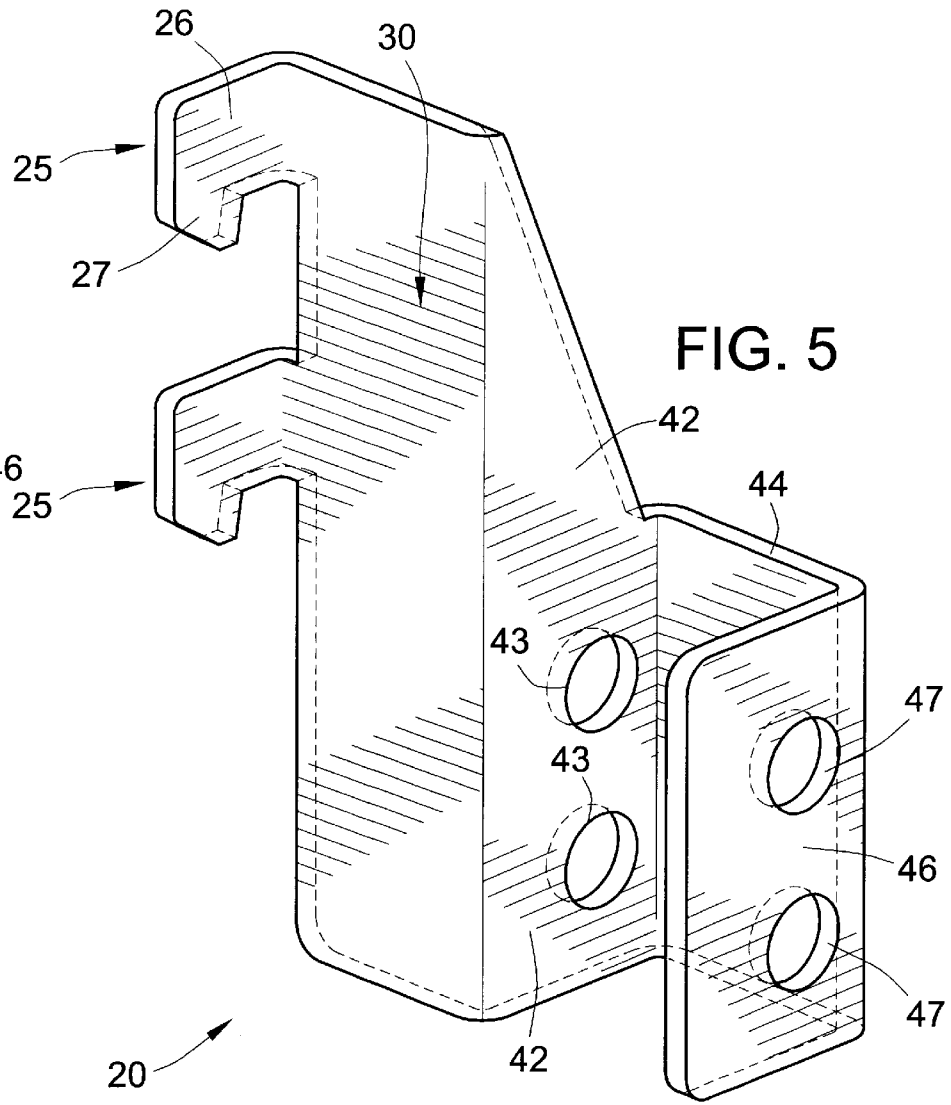
FIG. 5 is a top view of the mounting bracket shown in FIG. 4.
Figure 4:
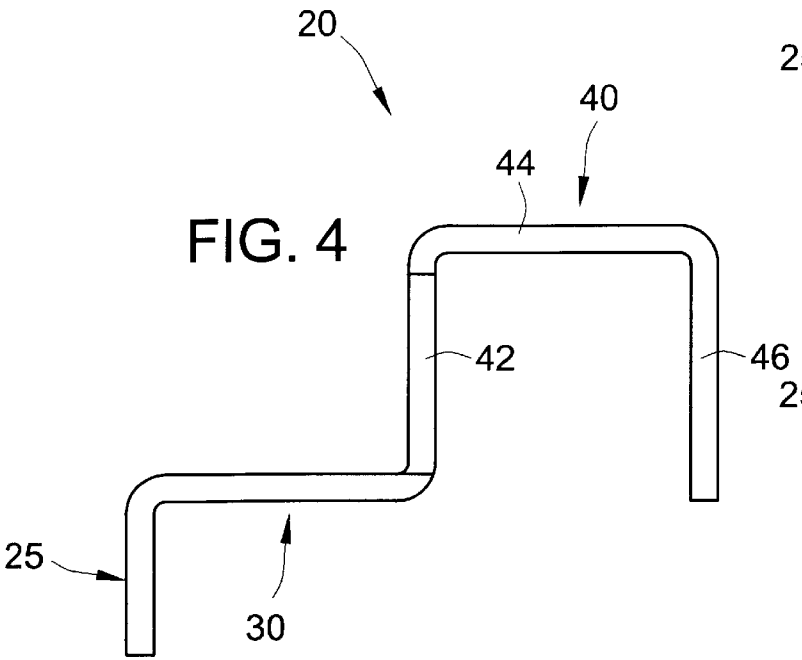
FIG. 4 shows a perspective view, taken from the left and rear, of the mounting bracket which forms a part of the invention.

In accordance with one of the novel aspects of the present invention, the other mounting bracket 20 is adjustably mounted to the support structure 13. More particularly, the mounting bracket 20 is horizontally adjustable to vary the distance between mounting bracket 20 and mounting bracket 21. The mounting bracket 20 has been shown alone in FIGS. 4 and 5 for detail.

The mounting bracket 20 generally includes a main portion 30 and a flange portion 40. The main portion 30 is vertically extending and includes two vertically-spaced prongs 25 at an upper end thereof. The prongs 25 each include a rearwardly extending portion 26 and a downwardly extending portion 27 for attachment to the slots or apertures 12' in the vertical beams 12. It will be recognized that the prongs 25 may take other shapes and forms, including a second portion 27 extending upwardly, as known in the art.

The flange portion 40 generally includes a first flange plate 42 extending transversely relative to the main portion 30, and more particularly extending outwardly away from the vertical support 10. A second flange plate 46 is laterally and horizontally spaced from the first flange plate 42. The first and second flange plates 42, 46 are connected by a link plate 44 which can be generally parallel to the main portion 30 as shown. The first flange plate 42 includes two vertically spaced apertures 43. The apertures 43 are sized and positioned to slidably receive the first and second horizontal members or rods 14, 15. Similarly, the second flange plate 46 includes two vertically spaced apertures 47 which are sized and positioned to receive the horizontal members 14, 15.

It will be recognized that the flange portion 40 may simply include a single flange plate, i.e. the first flange plate 42. Thus the flange portion 40 forms a first passageway and a second passageway, by way of apertures 43, for receiving the horizontal members 14, 15. When a second flange plate 46 is employed for additional support and strength, the pairs of apertures 43, 47 are aligned to form the first and second passageways for receiving the horizontal members 14, 15. In short, a single flange plate with a single aperture may be employed, however it is preferable to use a second flange plate and two vertically spaced passageways. This provides additional strength to the entire structure, and the use of two vertically spaced apertures resists rotational movement of the brackets 20 about a horizontal axis defined by the horizontal members.

Figure 3:
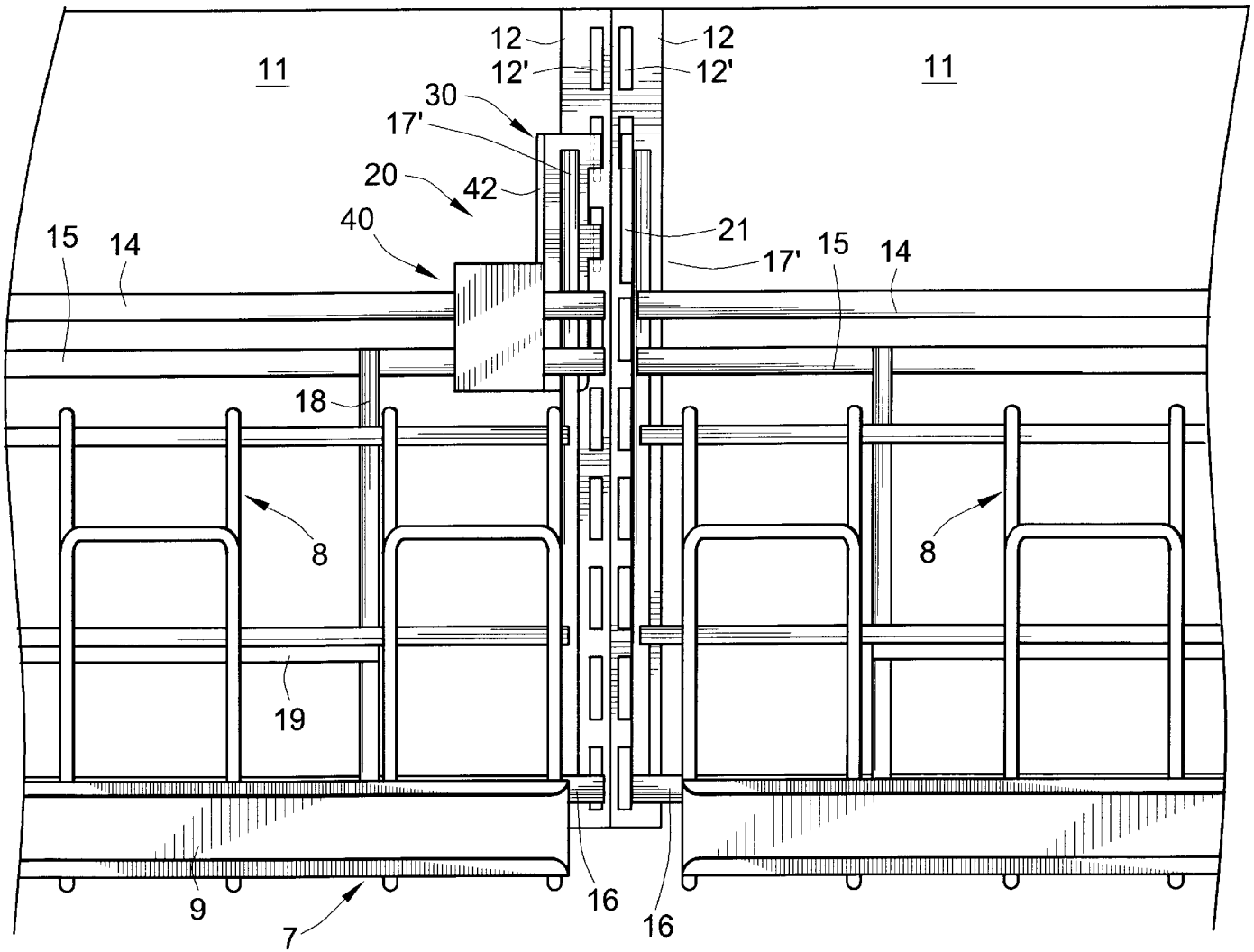
FIG. 3 illustrates an enlarged front view, partially cut away, of the display assembly shown in FIG. 1.

Accordingly, it can be seen that the mounting bracket 20 is horizontally adjustable along the first and second horizontal members 14, 15, as best seen in FIGS. 1 and 3. The lateral movement of the bracket 20 is restricted by the outer vertical post 17'. That is because the flange portion 40 projects outwardly beyond the position of the post 17'. The bracket 20 is also structured so that the vertical post 17' is adapted to lie against the main portion 30.

In operation, one side of the support structure 13, i.e. the left side having bracket 21 as shown in FIG. 1, is attached to the vertical beam 12 by way of bracket 21 and its prong. Then, the right end of assembly 7 and support structure 13 is swung towards the vertical support 10 and the mounting bracket 20 is horizontally adjusted to a position where it may be connected to the other vertical beam 12 via its prongs 25. Accordingly, the retail display assembly may be attached to any vertical support 10 despite slight variances in the distance between vertical beams 12.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retail display assembly for displaying merchandise on a vertical support, the retail display assembly comprising:

a display member structured to display merchandise;

a display support attached to the display member, the display support including a first horizontal member and first and second vertical members attached to opposing ends of the first horizontal member;

a first mounting bracket attached to a first end of the display support and structured for attachment to the vertical support;

a second mounting bracket attached to a second end of the display support and structured for attachment to the vertical support, the second mounting bracket being horizontally adjustable along the display support to vary the distance between the first and second mounting brackets;

wherein the second bracket is attached to the first horizontal member at the second end of the display support;

wherein the second mounting bracket includes a main portion and a flange portion, the main portion structured to lie against the vertical support and the flange portion structured to project outwardly from the main portion, the flange portion being connected to the first horizontal member; and wherein the flange portion includes an aperture sized to receive the first horizontal member.

2. The retail display assembly of claim 1, wherein the flange portion includes a first flange plate having the aperture and a second flange plate laterally spaced from and parallel to the first flange plate, the second flange plate having a second aperture aligned with the aperture and sized to receive the first horizontal member.

3. The retail display assembly of claim 1, the display support further including a second horizontal member attached to the first and second vertical members, the flange portion including a second aperture sized to receive the second horizontal member.

4. The retail display assembly of claim 3, wherein the second horizontal member is vertically spaced from the first horizontal member and the second aperture is vertically spaced from the aperture.

5. The retail display assembly of claim 1, wherein the second vertical member is positioned to lie against the main portion of the second mounting bracket.

6. A support structure for a product display apparatus, the support structure adapted for connections to a vertical support, the support structure comprising:

a first horizontal rod and a second horizontal rod, the first and second horizontal rods being vertically spaced apart;

a first post attached to a first end of the first and second rods;

a second post attached to a second end of the first and second rods opposite the first end;

a first back mounted to either the first post or the first and second horizontal rods at the first end;

a second back slidably mounted to the first and second horizontal rods for adjusting the distance between the first and second backs;

wherein the second back includes a flange projecting outwardly relative to the vertical support, the flange being connected to the first and second horizontal rods; and wherein the flange includes a first flange plate having the pair of vertically spaced apertures, and further includes a second flange plate laterally spaced from and parallel to the first flange plate, the second flange plate having a second pair of vertically spaced apertures aligned with the pair of apertures in the first flange plate and sized to slidably receive the first and second horizontal rods.

7. The support structure of claim 6, wherein the flange includes a pair of vertically spaced apertures sized and positioned to slidably receive the first and second horizontal rods.

8. The support structure of claim 6, wherein the flange is positioned inside of the second post.

9. The support structure of claim 8, wherein the second post limits the horizontal movement of the second back.

10. The support structure of claim 6, wherein the first back is fixedly mounted to either the first post or the first and second horizontal rods at the first end.

11. The support structure of claim 10, wherein the first back is fixedly mounted to the first post.

12. A support structure for a product display apparatus the support structure adapted for connection to a vertical support, the support structure comprising:

a first horizontal member;

first and second vertical members attached to opposing ends of the first horizontal member;

a first back attached to one of the first vertical member and the first horizontal member, the first back having a prong for attachment to the vertical support;

a second back connected to the first horizontal member and having a prong for attachment to the vertical support;

the second back including a main portion and a flange portion, the flange portion extending transversely relative to the main portion and projecting outward from the vertical support, the flange portion forming a first passageway sized to slidably receive the first horizontal member for adjusting the distance between the first and second backs; and wherein the flange portion includes a first flange plate having a first aperture, and further includes a second flange plate laterally spaced from the first flange plate, the second flange plate having a second aperture, the first and second apertures being aligned to form the passageway.

13. The support structure of claim 12 further comprising a second horizontal member attached to the first and second vertical members, the flange portion forming a second passageway sized to receive the second horizontal member.

14. The support structure of claim 12, wherein the second vertical member limits the horizontal movement of the second back.

* * * * *